US008143591B2

(12) United States Patent
Gefter et al.

(10) Patent No.: US 8,143,591 B2
(45) Date of Patent: Mar. 27, 2012

(54) COVERING WIDE AREAS WITH IONIZED GAS STREAMS

(76) Inventors: Peter Gefter, South San Francisco, CA (US); Aleksey Klochkov, San Francisco, CA (US); John Menear, Santa Cruz, CA (US)

( * ) Notice: Subject to any disclaimer, the term of this patent is extended or adjusted under 35 U.S.C. 154(b) by 1 day.

(21) Appl. No.: 12/925,519

(22) Filed: Oct. 22, 2010

(65) Prior Publication Data

US 2011/0095200 A1 Apr. 28, 2011

Related U.S. Application Data

(60) Provisional application No. 61/279,784, filed on Oct. 26, 2009.

(51) Int. Cl.
*H01J 27/00* (2006.01)

(52) U.S. Cl. ..... 250/423 R; 250/281; 250/424; 250/492.1; 250/492.3

(58) Field of Classification Search ..... 250/281, 250/282, 288, 423 R, 424, 492.1, 492.3
See application file for complete search history.

(56) References Cited

U.S. PATENT DOCUMENTS

| | | | | |
|---|---|---|---|---|
| 3,374,941 | A | 3/1968 | Okress | 315/111.91 |
| 3,585,060 | A | 6/1971 | Gourdine et al. | 427/460 |
| 3,764,804 | A | 10/1973 | Hirschman | 250/49.5 |
| 3,768,258 | A | 10/1973 | Smith et al. | 60/275 |
| 4,258,736 | A | 3/1981 | Denbow | 137/2 |
| 4,734,105 | A | 3/1988 | Eliasson et al. | 95/62 |
| 4,812,711 | A | 3/1989 | Torok et al. | 315/111.9 |
| 4,976,752 | A | 12/1990 | Torok et al. | 96/43 |
| 5,116,583 | A | 5/1992 | Batchelder et al. | 422/186.07 |
| 5,296,018 | A | 3/1994 | Suzuki | 95/65 |
| 5,447,763 | A | 9/1995 | Gehlke | 428/34.1 |
| 5,550,703 | A | 8/1996 | Beyer et al. | 361/229 |
| 5,650,203 | A | 7/1997 | Gehlke | 428/34.1 |
| 5,847,917 | A | 12/1998 | Suzuki | 361/213 |
| 6,373,680 | B1 | 4/2002 | Riskin | 361/231 |
| 6,563,110 | B1 | 5/2003 | Leri | 250/282 |
| 6,566,887 | B2 | 5/2003 | Smith et al. | 324/514 |
| 6,636,411 | B1 | 10/2003 | Noll | 361/213 |

(Continued)

FOREIGN PATENT DOCUMENTS

JP 2004273293 9/2004

(Continued)

OTHER PUBLICATIONS

Freescale Semiconductor, Inc. datasheet (Rev 0) for MPXV6115 Series including data for MPXV6115VC6U Integrated Pressure Sensor, 8 pages on 8 sheets, 2009.

(Continued)

*Primary Examiner* — Phillip A Johnston
*Assistant Examiner* — Hanway Chang
(74) *Attorney, Agent, or Firm* — The PatentSource

(57) ABSTRACT

Ion delivery manifolds with a gas transport channel, for receiving an ionized gas stream, and plural outlets that divide the gas stream into plural neutralization gas streams that are directed toward respective plural target regions are disclosed. At least generally equal ion distribution across the target regions is achieved by using different ion flow rates through the plural outlets. Methods of delivering plural neutralization streams to respective plural target regions include steps for receiving an ionized gas stream, for dividing the ionized gas stream into plural neutralization streams, and for directing the neutralization streams toward respective target regions. At least generally equal ion distribution across the target regions is achieved by differing the ion flow rates of the neutralization streams.

27 Claims, 8 Drawing Sheets

U.S. PATENT DOCUMENTS

| | | | | |
|---|---|---|---|---|
| 6,646,856 | B2 | 11/2003 | Lee et al. | 361/232 |
| 6,693,788 | B1 | 2/2004 | Partridge | 361/231 |
| 6,807,044 | B1 | 10/2004 | Vernitsky et al. | 361/230 |
| 6,850,403 | B1 | 2/2005 | Gefter et al. | 361/230 |
| 7,051,419 | B2 | 5/2006 | Schrom et al. | 29/854 |
| 7,120,007 | B2 | 10/2006 | Nakasone et al. | 361/231 |
| 7,208,030 | B2 | 4/2007 | Totoki | 96/19 |
| 7,356,987 | B2 | 4/2008 | Kiser et al. | 60/278 |
| 7,365,316 | B2 | 4/2008 | Miller et al. | 250/288 |
| 7,375,944 | B2 | 5/2008 | Izaki et al. | 361/230 |
| 7,697,258 | B2 | 4/2010 | Vernitskiy et al. | 361/230 |
| 7,813,102 | B2 | 10/2010 | Gefter et al. | 361/213 |
| 2004/0045442 | A1 | 3/2004 | Ziya Ramizovich et al. | 96/94 |
| 2006/0187609 | A1 | 8/2006 | Dunn | 361/230 |
| 2006/0193100 | A1 | 8/2006 | Izaki et al. | 361/220 |
| 2006/0260928 | A1 | 11/2006 | Avnery et al. | 204/157.3 |
| 2006/0285269 | A1 | 12/2006 | Ohtsuka et al. | 361/225 |
| 2007/0006478 | A1 | 1/2007 | Kotsuji | 34/96 |
| 2007/0025771 | A1 | 2/2007 | Robles Flores et al. | 399/172 |
| 2007/0158578 | A1 | 7/2007 | Vernitskiy | 250/423 R |
| 2007/0181820 | A1 | 8/2007 | Hwang | 250/396 R |
| 2008/0078291 | A1 | 4/2008 | Daukant | 95/69 |
| 2008/0130190 | A1 | 6/2008 | Shimada | 361/231 |
| 2008/0225460 | A1 | 9/2008 | Gefter et al. | 361/213 |
| 2008/0232021 | A1 | 9/2008 | Gefter et al. | 361/213 |
| 2009/0050801 | A1 | 2/2009 | Fedorov | 250/288 |
| 2009/0168289 | A1 | 7/2009 | Shimada | 361/213 |
| 2010/0044581 | A1 | 2/2010 | Fujita et al. | 250/423 R |
| 2010/0128408 | A1 | 5/2010 | Takayanagi | 361/213 |

FOREIGN PATENT DOCUMENTS

| | | | |
|---|---|---|---|
| JP | 2004362951 | 12/2004 | |
| JP | 2006236763 | 9/2006 | 3/4 |
| JP | 2007048682 | 2/2007 | 3/4 |

OTHER PUBLICATIONS

Atmel Corporation datasheet for 8-bit AVR with 8K Bytes In-System Programmable Flash including data for ATMEGA8 microcontroller, 22 pages on 11 sheets, 2003.

Fox Valve Development Corp. Bulletin 401 A including data for Fox Mini-Eductors, 10 pages on 10 sheets, Nov. 21, 2002.

Anver Corporation catalog, Section 3 (Air Powered Vacuum Generators & Accessories) including datas for ANVER JV-09 Series Mini Vacuum Generator, 88 pages on 44 sheets, date unknown.

United Filtration System Inc., disposable in-line filter datasheets including the DIF-MN50 filter, 6 pages on 6 sheets, Jan. 31, 2006.

PCT Application PCT/US01/01215, Notification of Transmittal of the International Search Report . . . International Search Report, and Written Opinion of the International Searching Authority mailed Jul. 9, 2010; 10 pages total.

PCT Application PCT/US2010/053741, Notification of Transmittal of the International Search Report . . . , International Search Report, and Written Opinion of the International Searching Authority mailed Dec. 22, 2010; 13 pages total.

PCT Application PCT/US2010/053996, Notification of Transmittal of the International Search Report . . . , International Search Report, and Written Opinion of the International Searching Authority, mailed Dec. 23, 2010; 11 pages total.

Automated JPO/INIPIT translation of Abstract, Description, and Claims of JP 2007-048682 A, 8 pages.

Automated JPO/INIPIT translation of Abstract, Description, and Claims of JP 2006-236763 A, 9 pages.

PCT Application PCT/US2011/024010, Notification of Transmittal of the International Search Report . . . and associated International Search Report, mailed Apr. 6, 2011; 4 pages total.

PCT Application PCT/US2011/024010, Written Opinion of the International Searching Authority, mailed Apr. 6, 2011; 10 pages total.

Automated JPO/INPIT translation of JP 2004-273293 28 pages.

Automated JPO/INPIT translation of JP 2004-362951 29 pages.

| Distance from manifold head (Cm) | Left 20 cm of grid | | | Centerline | | | Right 20 cm of grid | | |
|---|---|---|---|---|---|---|---|---|---|
| | DT+ (seconds) | DT- (seconds) | Balance (volts) | DT+ (seconds) | DT- (seconds) | Balance (volts) | DT+ (seconds) | DT- (seconds) | Balance (volts) |
| 0 | 31.5 | 49.5 | -3 | 39.8 | 59.5 | -2 | 111.2 | 279.0 | 0 |
| 10 | | | | | | | | | |
| 20 | 15.4 | 20.1 | -4 | 15.7 | 17.8 | -1 | 67.3 | 140.6 | -1 |
| 30 | | | | | | | | | |
| 40 | 43.6 | 94.7 | -3 | 30.6 | 55.3 | -7 | 35.3 | 66.7 | -3 |
| 50 | | | | | | | | | |
| 60 | 18.5 | 27.9 | -3 | 12.0 | 16.8 | -9 | 15.5 | 22.5 | -5 |
| 70 | | | | | | | | | |
| 80 | 71.2 | 86.4 | 2 | 28.8 | 43.5 | -3 | 44.1 | 58.3 | 1 |
| 90 | | | | | | | | | |
| 100 | 61.0 | 62.7 | 2 | 50.1 | 72.9 | -1 | 68.4 | 73.9 | 3 |
| 110 | | | | | | | | | |
| 120 | 35.1 | 40.4 | -2 | 30.0 | 42.7 | -2 | 44.4 | 50.7 | 2 |
| 130 | | | | | | | | | |
| 140 | 36.5 | 40.0 | 1 | 26.4 | 40.1 | -4 | 41.5 | 45.5 | 2 |
| **Mean (60 to 140 cm)** | **44.5** | **51.5** | **0.0** | **29.5** | **43.2** | **-3.8** | **42.8** | **50.2** | **0.6** |

Figure 8

COVERING WIDE AREAS WITH IONIZED GAS STREAMS

CROSS-REFERENCE TO RELATED APPLICATIONS

This application claims the benefit under 35 U.S.C. 119(e) of co-pending U.S. Provisional Application Ser. No. 61/279,784 filed Oct. 26, 2009 and entitled "COVERING WIDE AREAS WITH IONIZED GAS STREAMS"; which Provisional Application is hereby incorporated by reference in its entirety.

FIELD OF THE INVENTION

This invention relates to the distribution of ionized gas streams from an ionizer over a large target area. More particularly, this invention is directed to novel methods of unequally dividing, and apparatus for the unequal division of, ionized gas streams to promote more uniform delivery of ions to a large target area.

DESCRIPTION OF RELATED ART

As is known in the art many ionizers, the ion emitter(s) may receive a positive voltage during one time period and a negative voltage during another time period. Hence, such emitter(s) generate bi-polar charge carriers including both positive and negative ions and these charge carriers are directed toward a target through a manifold of some form or other.

Conventional ion stream manifolds to distribute gas ions (see, for example, Ion System 4210 In-Line Ionizer and Japanese Patent JP 20070486682) typically comprise an elongated cylindrical tube with multiple holes distributed along the length of the manifold to permit ions to exit the tube. In such devices, hole diameters have been sized to create an over-pressure within the tube and that forces ionized gas outward through the holes. These manifolds equally divide ionized gas streams along the longest manifold axis so that roughly the same quantity of gas escapes through each hole. Distribution of ionized gas flow, however, is complex phenomenon as the media comprising three different species—carrying gas, positive and negative ions. So, a manifold that seeks to equally divide gas streams exiting the manifold will not provide an equal distribution of ions to a large charged target area.

BRIEF SUMMARY OF THE INVENTION

In one form, the present invention overcomes the above-stated and other deficiencies of the prior art by providing an ion delivery manifold for use with an ionizer of the type that converts a non-ionized gas stream into an ionized gas stream. The manifold may have a gas transport channel with an inlet that receives the ionized gas stream from the ionizer and at least first and second outlets that divide the ionized gas stream into first and second neutralization gas streams directed toward respective first and second regions of a wide-area target. To achieve at least generally equal ion distribution across the first and second regions, the ion flow rate through the first outlet may be higher than the ion flow rate through the second outlet and the first region may be further from the first outlet than the second region is from the second outlet.

Further benefits are achieved by minimizing ion recombination during delivery of ionized gas streams to regions of target surface. Recombination is undesirable because it consumes two oppositely charged (useful) ionized gas molecules, and produces two neutral (not useful for neutralization) gas molecules. As charged ionized molecules are consumed, the ability to neutralize charges on a target is reduced. By reducing recombination and by compensating for anticipated recombination in certain ways, the invention is able to more closely approximate uniform ion distribution across the charge-neutralization target.

The inventive manifolds may minimize the residence time of the ionized gas streams exiting the manifold and directed to regions of the wide-area target furthest from the manifold. Since ion distribution depends on residence time within the manifold, the lower the residence time, the less ion recombination occurs. In accordance with some embodiments of the invention, residence time within the transport channel is minimized by eliminating dead zones or reverse flows (created by turbulent gas movement). The inventive manifolds are, therefore, designed to more quickly transport ions from the inlet through some outlets to thereby minimize residence time within those portions of the manifold.

In some embodiments, inventive manifolds may use the momentum of the gas stream(s) moving through the manifold to push at least one of the neutralization gas streams exiting the manifold toward greater distances. In one desirable configuration, at least one outlet lies along an unobstructed path from the manifold inlet and the momentum of the incoming ionized gas stream is used to push one of the divided ionized gas streams through that orifice.

In some embodiments, at least a portion of the transport channel may have a curved interior surface and plural outlets may extend from the curved interior surface of the transport channel. Further, at least one outlet may be at least substantially tangentially aligned with the curvature of the inner surface of the through-channel. The inventive manifolds may have a small footprint if used with tool and robotic applications, and may be compatible with a high-frequency ion sources.

Inventive method embodiments include methods of delivering plural neutralization gas streams to respective plural regions of a wide-area charge-neutralization target. Such methods may include steps for receiving an ionized gas stream flowing in a downstream direction, for dividing the ionized gas stream into plural neutralization gas streams, and for directing the plural neutralization gas streams toward respective plural regions of the wide-area target. To achieve at least generally equal ion distribution across the wide-area target, the ion flow rate of one of the neutralization gas streams may be higher than the ion flow rate of the other neutralization gas streams and the neutralization gas stream with the highest ion flow rate may be directed to the furthest region of the wide-area target.

In sum, manifold structures and/or distribution methods in accordance with the invention improve neutralization gas stream delivery by relying on one or more of the following four guidelines (1) minimize the pressure drop across at least a portion of the manifold itself, (2) minimize the residence time of ions within at least a portion of the manifold, (3) direct more ions to distant target locations than to near locations since recombination losses will be greater at distant locations, and/or (4) employ air or gas entrainment downstream of the manifold to reduce ion density.

BRIEF SUMMARY OF THE DRAWINGS

FIG. 8 is a table showing discharge times and ion distribution (ionization-neutralization coverage) results for a preferred embodiment directed to a 1400 mm by 400 mm wide-area target.

DETAILED DESCRIPTION OF THE PREFERRED EMBODIMENTS

Figure 1:
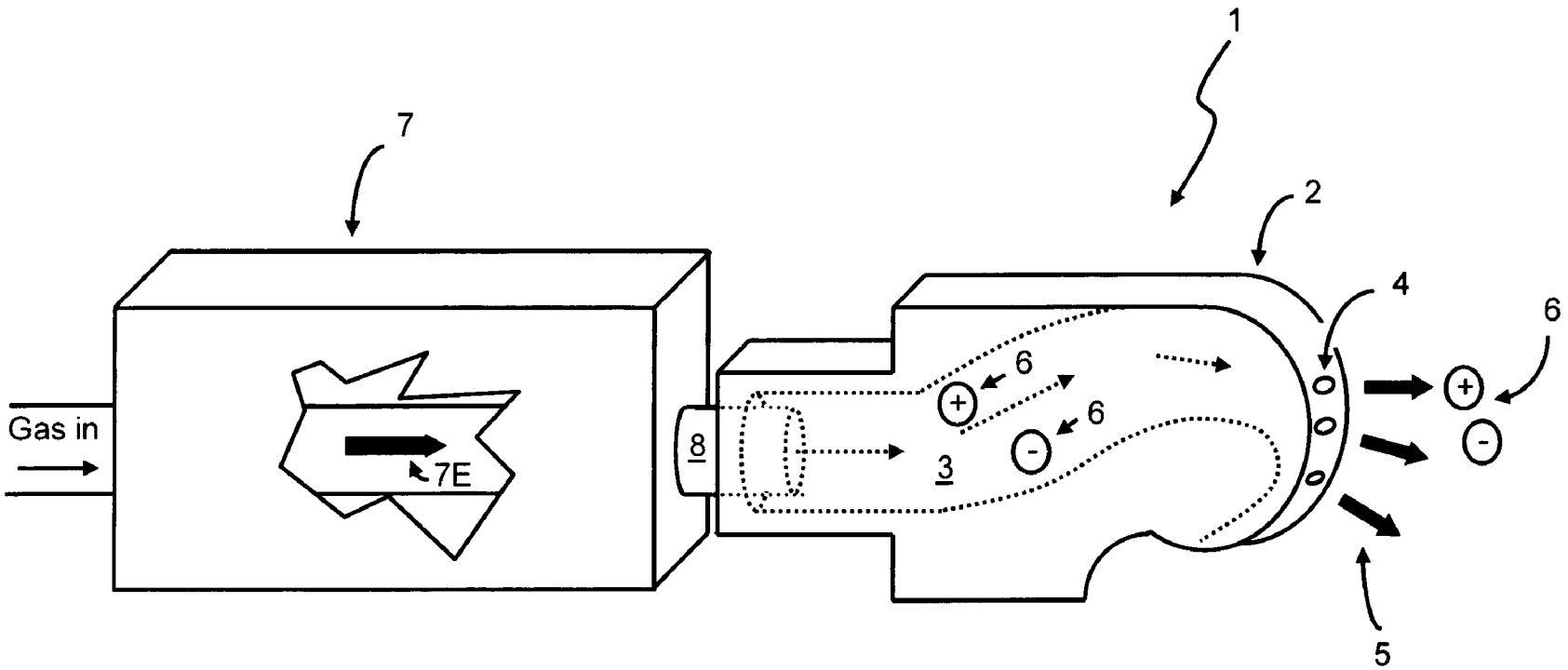
FIG. 1 is a diagram of an in-line ionizer having an emitter and being attached to a first preferred manifold.

FIG. 1 shows a manifold 1 embodiment that has proven performance. The inlet of the manifold 1 transport channel 3 connects to a gas ionizer 7 by mating with the ionizer outlet 8. The means for mating an inlet of the transport channel 3 to the ionizer outlet 8 may be any one or more of a male-to-female slip fit, a threaded fitting, keyed fitted surfaces and/or other means known in the art. In this example, the ion emitter 7E may be a corona discharge electrode with a pointed end that is oriented toward the gas transport channel 3 of the manifold 1 and wherein the electrode 7E is disposed within a non-ionized gas stream which will be converted into an ionized gas stream by the ionizer. The ionized gas flow may be in the range 30-200 L/min, preferably 60-100 L/min.

In use the ionizer receives non-ionized gas stream (Gas in) that defines a downstream direction and produces ions 6 to thereby form an ionized gas stream. Ions 6 produced by the ionizer 7 are carried by the ionized gas stream (air, nitrogen, argon, etc.) through the ion outlet 8 into the inlet of through channel 3.

As shown, the manifold 1 includes an outside surface 2 and an enclosed gas transport channel 3 bounded by an interior surface denoted by dotted lines in the various Figures. The ionized gas stream 6 within the transport channel 3 flows toward the plural outlets/orifices 4 where it is unequally divided into plural neutralization streams. The plural neutralization streams exit the orifices 4 (which may be spray orifices) and are directed toward a wide-area target along arrows 5 to neutralize charge on respective regions of the target (not shown). In certain preferred embodiments, the enclosed gas transport channel 3 may have a varying cross-sectional area that decreases toward one dead end of the channel (i.e., the channel may be closed from one side). This way, gas pressure inside channel 3 may be increased and the ion flow may be directed to the outlets 4. In certain preferred embodiments, the gas transport channel 3 may comprise a dielectric polymer with a charge relaxation time of 100 seconds or more and the inner surface of the gas transport channel (see dotted lines) may have a surface roughness not exceeding Ra=32 micro inches. Conventional materials of this type include engineered thermoplastic resins with good manufacturability (processability), thermal stability, temperature resistance, chemical resistance and/or fatigue resistance such as thermoplastics and thermosetting polymers. Some conventional polycarbonates resins with some or all of these properties include PEEK®, Polycarbonate, DELRIN®, and ACRYLIC®. The inventive manifolds discussed herein may be formed in any conventional manner consistent with the remainder of this disclosure including machining or molding it in one or more portions and assembling the same together (if molded in more than one portion).

Figure 2:
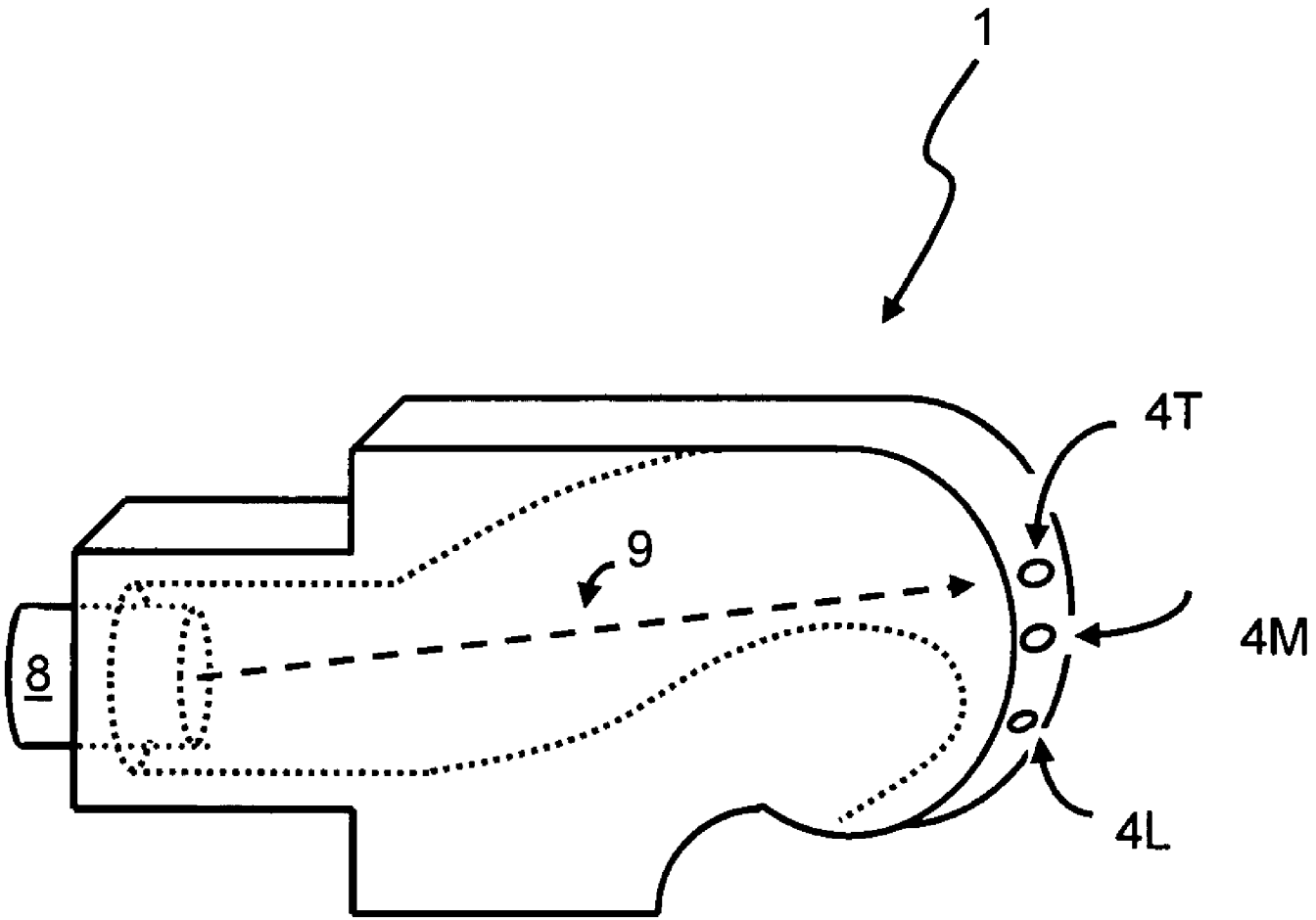
FIG. 2 demonstrates that the manifold embodiment of FIG. 1 provides an unobstructed path between the manifold inlet and the orifice that passes the largest portion of ionized gas flow.

FIG. 2 shows essentially the same manifold 1 as shown in FIG. 1. Note that the top spray outlet 4T lies on an unobstructed path 9 between the outlet 4T and the ionizer outlet 8 (and the inlet of the through channel 3). The significance of the in-line positioning is that the momentum of the ionized gas stream flowing through ionizer outlet 8 is continued through the top outlet/orifice 4T. Ion flow exiting orifice 4T will, therefore, be greater than ion flow exiting the middle outlet/orifice 4M and the lower outlet/orifice 4L. Outlet 4T preferably directs neutralization ion flow toward the most distant region of the charged target to be neutralized because the preserved momentum of the gas moving therethrough is capable of delivering ions greater distances with fewer losses.

Note that the middle orifice 4M and the lower orifice 4L do not lie along path 9. Considerable gas momentum from the ion outlet 8 is lost before the ion flow exits middle orifice 4M and the lower orifice 4L. Although fewer ions exit through middle hole 4M and the lower hole 4L (compared to hole 4T), outlets 4M and 4L are directed to mid-target and near-target regions, respectively. This is desirable for uniform ion distribution at the target surface because, even though fewer ions exit middle and lower outlets 4M and 4L, recombination will destroy fewer ions over these shorter distances (compared to hole 4T and the more distant target region associated with it). Thus, a wide coverage manifold intentionally delivers unequal quantities of ionized gas through all holes 4T, 4M, 4L. The cross-sectional area of each outlet may depend on its position (distance) from and the dimensions of its targeted neutralization region. For example, orifice 4T (see unobstructed path 9) supplying ion flow to the most remote targeted region may have a cross-sectional area that is smaller than (provides higher gas velocity and entrainment) or equal to that of outlet 4M. Outlet 4M permits ion flow to a closer target region, but one that has a larger neutralization region (see FIG. 2). Outlet 4L may have smaller cross-sectional area than outlet 4M because it's positioned closest to target and ion flow is the lowest. This arrangement substantially compensates for inherently unequal ion recombination to thereby provide substantially uniform ion current density at the charged target surface. This makes the inventive manifolds more effective than a manifold that distributes gas streams evenly due to internal pressure buildup.

Further, recombination can be minimized by reducing the density of ions and by reducing the transit (travel) time to the target. Also, recombination is decreased by minimizing interaction of ionized gas flow with walls of manifold.

Figure 3:
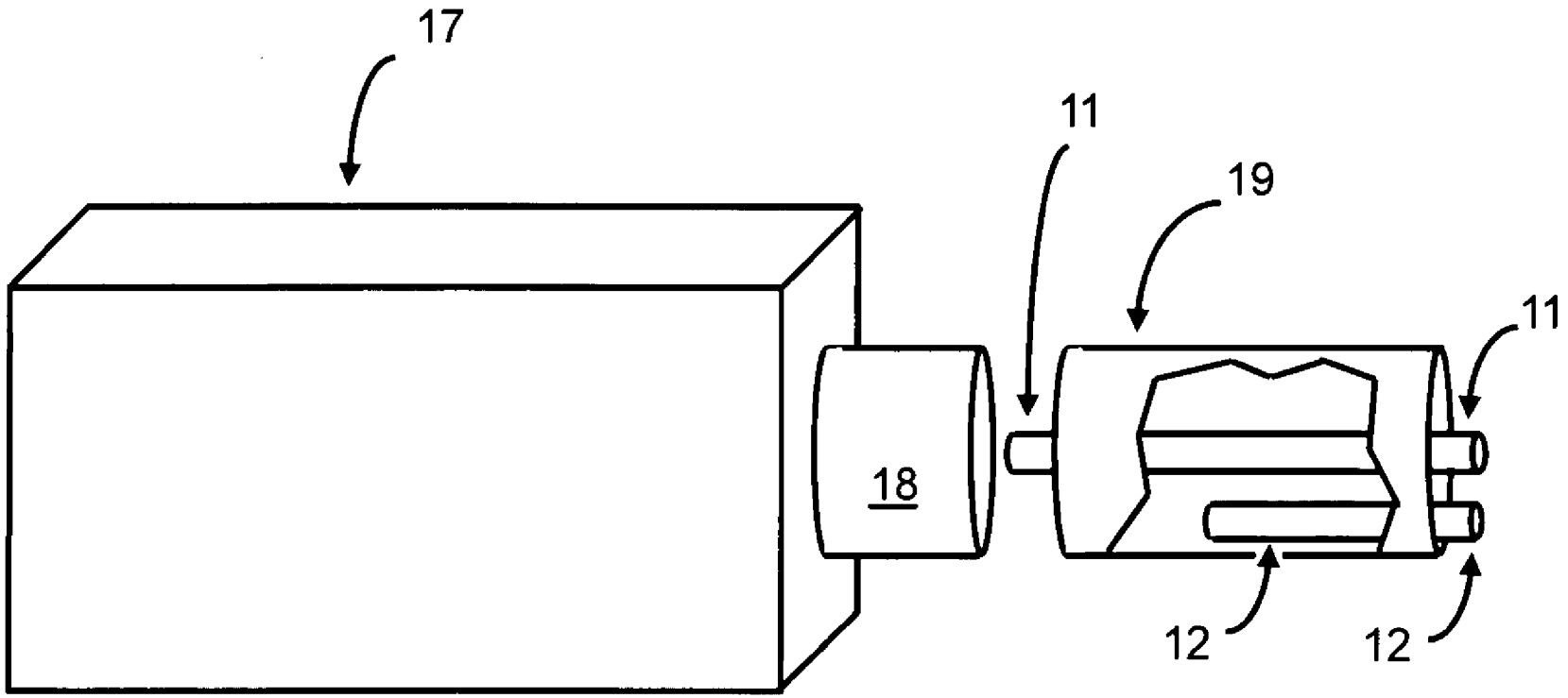
FIG. 3 shows another preferred embodiment that utilizes ion guide tubes wherein tubes close to the manifold inlet and aligned to the manifold inlet axis are ideally situated to capture momentum, and transport the ions to distant locations.

Turning now to FIG. 3, there is shown a tubular manifold that utilizes an alternative configuration and is capable of distributing ions over a 6 foot square area that is 20 inches away from the outlet tubes of the manifold. As shown, the ionizer 17 delivers an ionized gas stream through an ion outlet 18, which connects to an inventive manifold 19. Inside manifold 19 are a series of tubes 11, 12. While the invention is not so limited, only two tubes 11, 12 are shown for simplicity.

Tube 11 is positioned close to the ionizer outlet 18, and is aligned with the central axis of the ionizer outlet 18. Both closeness and alignment contribute to a preferred ion flow path through manifold 19. Tube 11 is directed to distant target locations. By contrast, the opening of tube 12 is further away from the ionizer outlet 18 than tube 11 and tube 12 is not aligned with the central axis of the ion outlet 18. Tube 12 is, therefore, directed to near target locations.

In some embodiments, the tubes 11, 12 may have different cross-sectional areas and tubes 11, 12 are preferably fabricated from non-conductive materials. Further, the exit opening of manifold 19 may be elliptical or circular (or other geometry) in cross-sectional shape, depending on the target shape.

Figure 4:
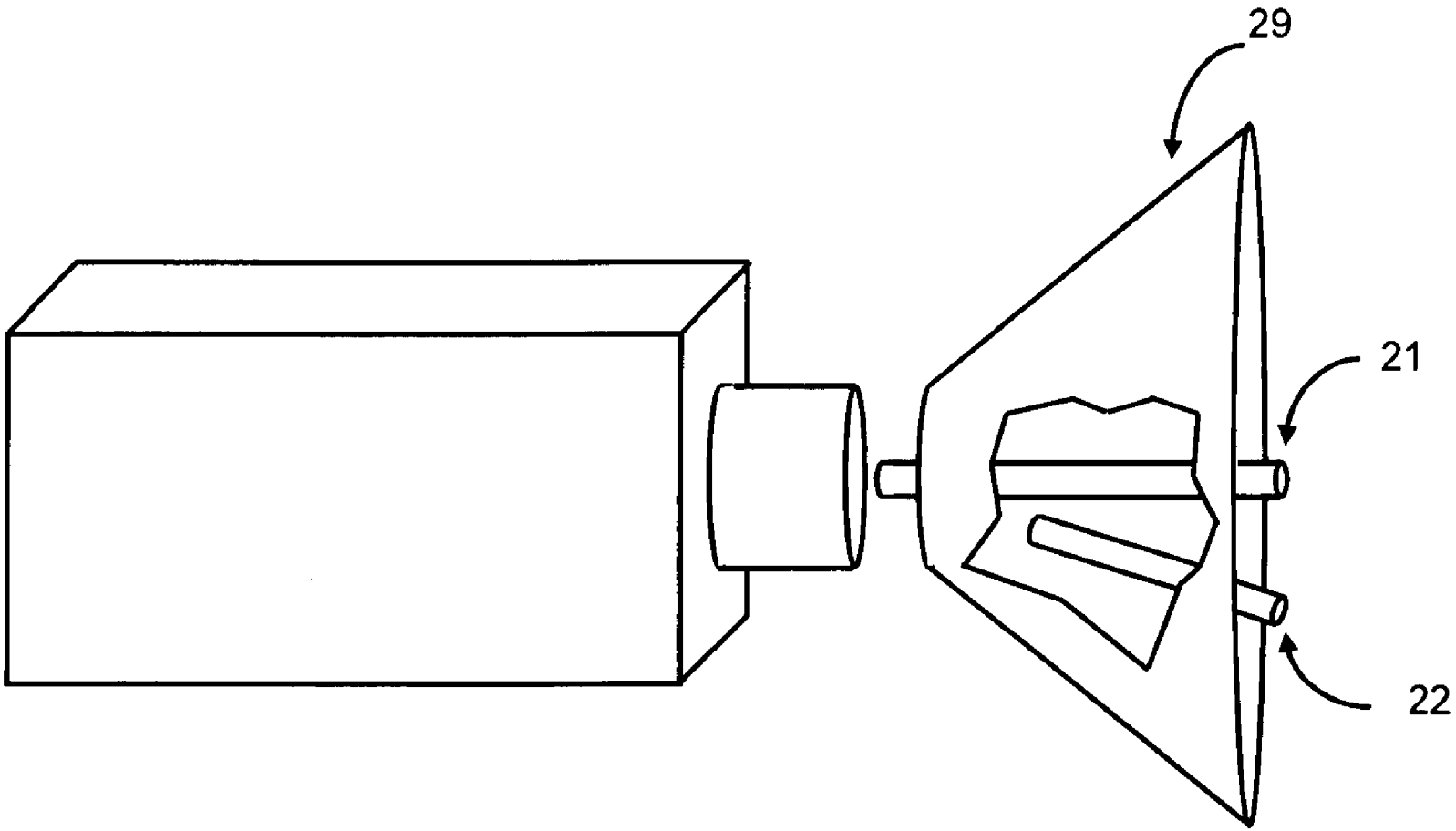
FIG. 4 shows a preferred embodiment in which ion guide tubes are used in conjunction with a flared or generally frustoconical manifold.

FIG. 4 shows a preferred embodiment that is closely related to that of FIG. 3. The difference is that the manifold 29 has a flared or frustoconical shape. In this embodiment, tube 21 employs momentum and positioning to transport ion flow to a long-distance region of the target. By contrast, tube 22 receives less momentum and is oriented oblique to the main flow from the ion outlet. Tube 22 is, therefore, directed toward a short-distance region of the target.

Figure 5:
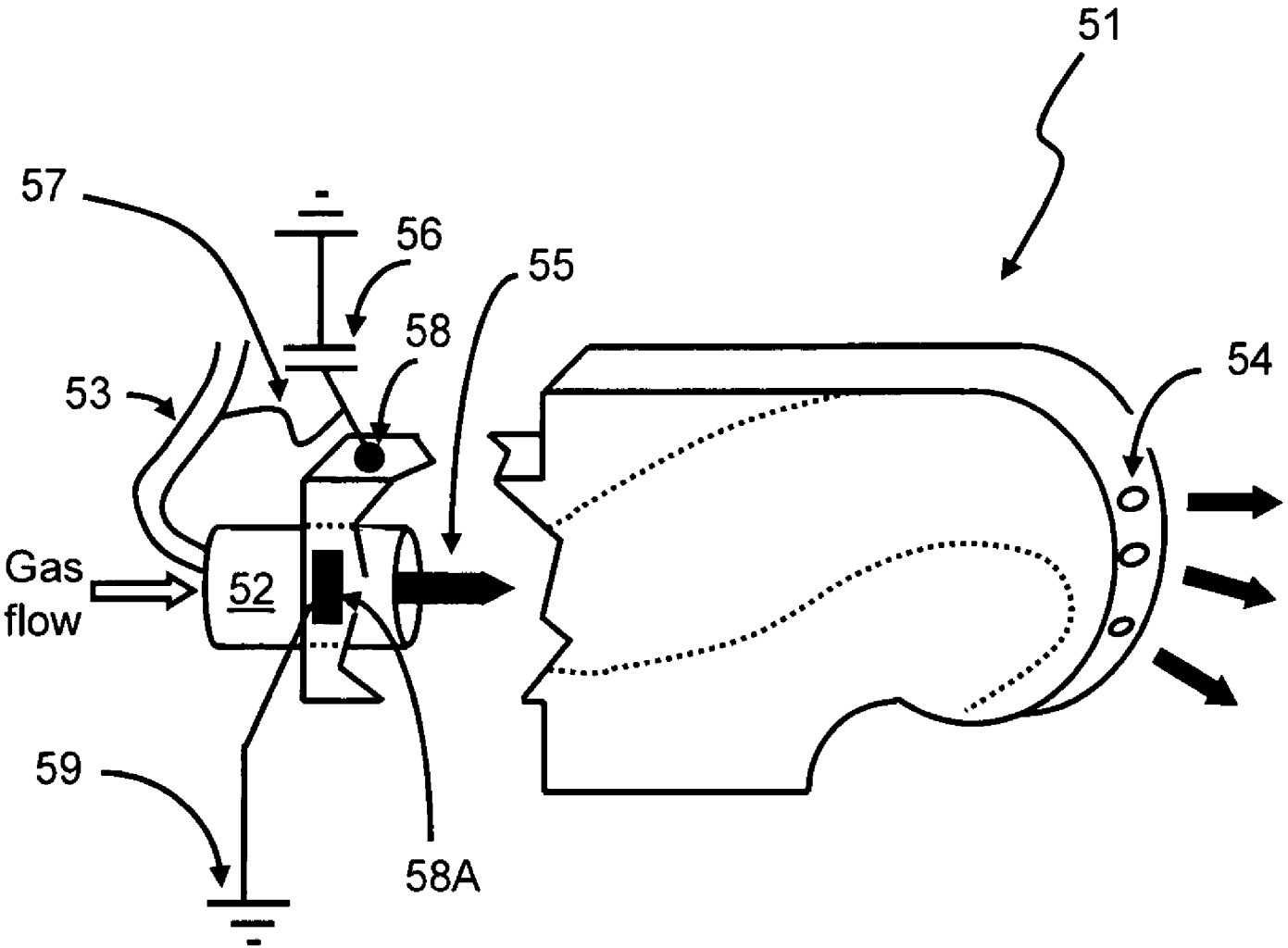
FIG. 5 shows a further preferred embodiment in which an ionization cell, with an ion emitter and reference electrode is incorporated into an inventive manifold, wherein recombination is minimized and efficiency is improved by shortening the distance between the emitter and the manifold outlet holes.

FIG. 5 shows a manifold 51 that has an ion emitter 55 and one or more reference electrodes 58, 58A incorporated into the manifold 51 itself. The reference electrode(s) may be electrically coupled to ground 59 or to a capacitive circuit 56 and, through cable 57, to a control system for controlling a high-voltage/high-frequency power supply (not shown). In this configuration, the bi-polar ionized gas is produced closer to the manifold outlets 54. This gives significantly less time for ion recombination to occur within the manifold (compared to various other embodiments described herein) so the harvest of ions is improved. The inlet port 52 serves as a conduit for incoming non-ionized (and possibly compressed) gas and as a conduit for electrical cables and/or connectors 53. In the preferred embodiment of FIG. 5, the ionizer may be a corona discharge electrode with an ionizing tip that is oriented toward the gas transport channel of the manifold, wherein the electrode is positioned inside a shell with an evacuation port and an outlet that is at least partially disposed within the gas transport channel.

Figure 6:
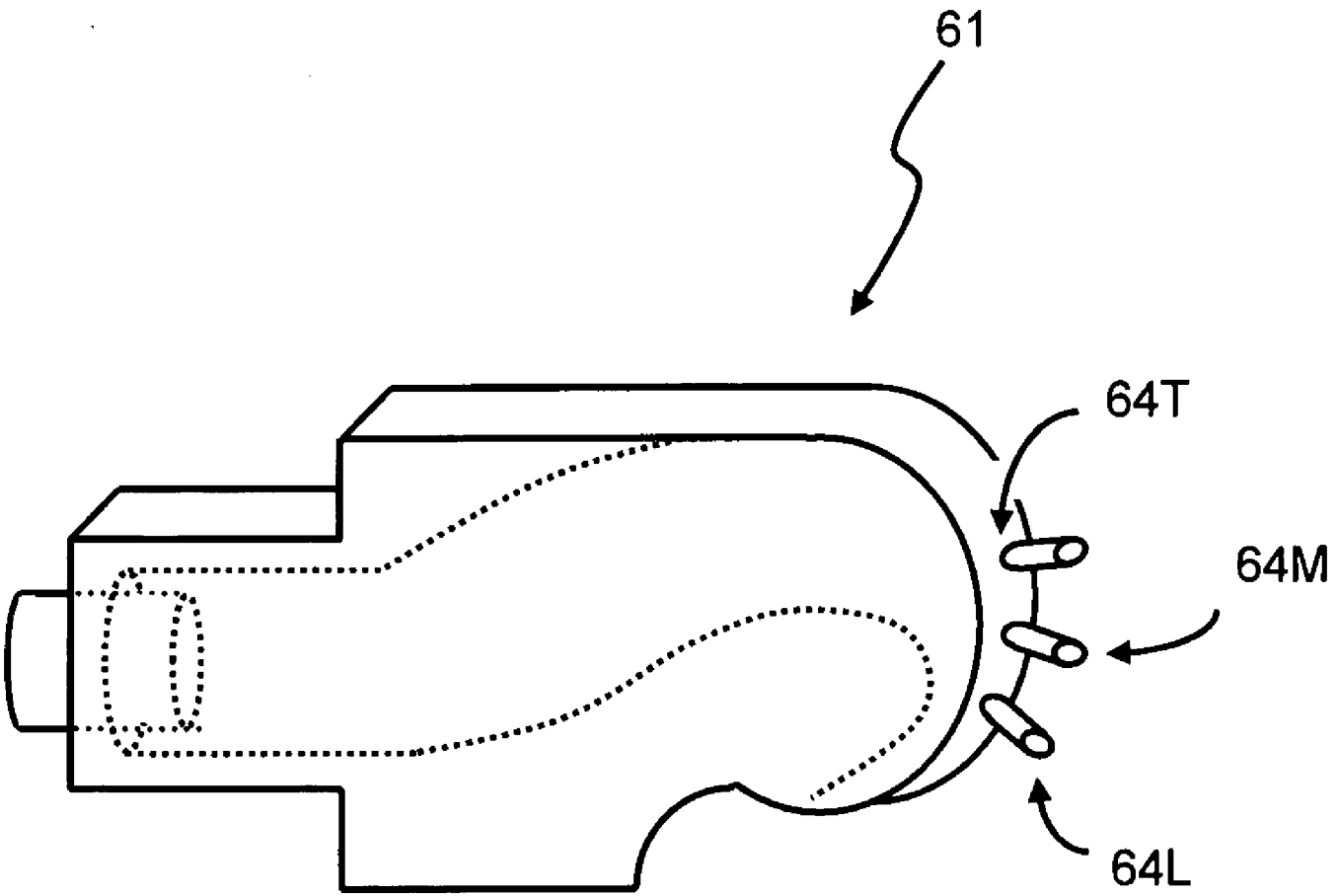
FIG. 6 shows another preferred embodiment which the manifold outlets take the form of tubelettes to direct plural divided neutralization streams exiting the manifold toward respective regions of a wide-area target surface.

FIG. 6 shows a manifold 61 in which outlet holes are replaced with short tubes/tubelettes 64T, 64M, 64L. In a variation, the short tubelettes 64T, 64M, 64L are inserts with varying cross-sectional areas. In this way, ions are distributed with greater angular control. The velocity of ion flow through tube 64 T is higher than the velocity of the ion flow trough tubes 64M and 64L. This creates entrainment effect drawing an additional volume of ambient gas toward the wide area target to form plural neutralization streams. The additional volume of ambient gas dilutes the ionized gas steam decreasing recombination losses. Ionized gas flow may be in the range 30-200 L/min, preferably 60-100 L/min.

Figure 7:
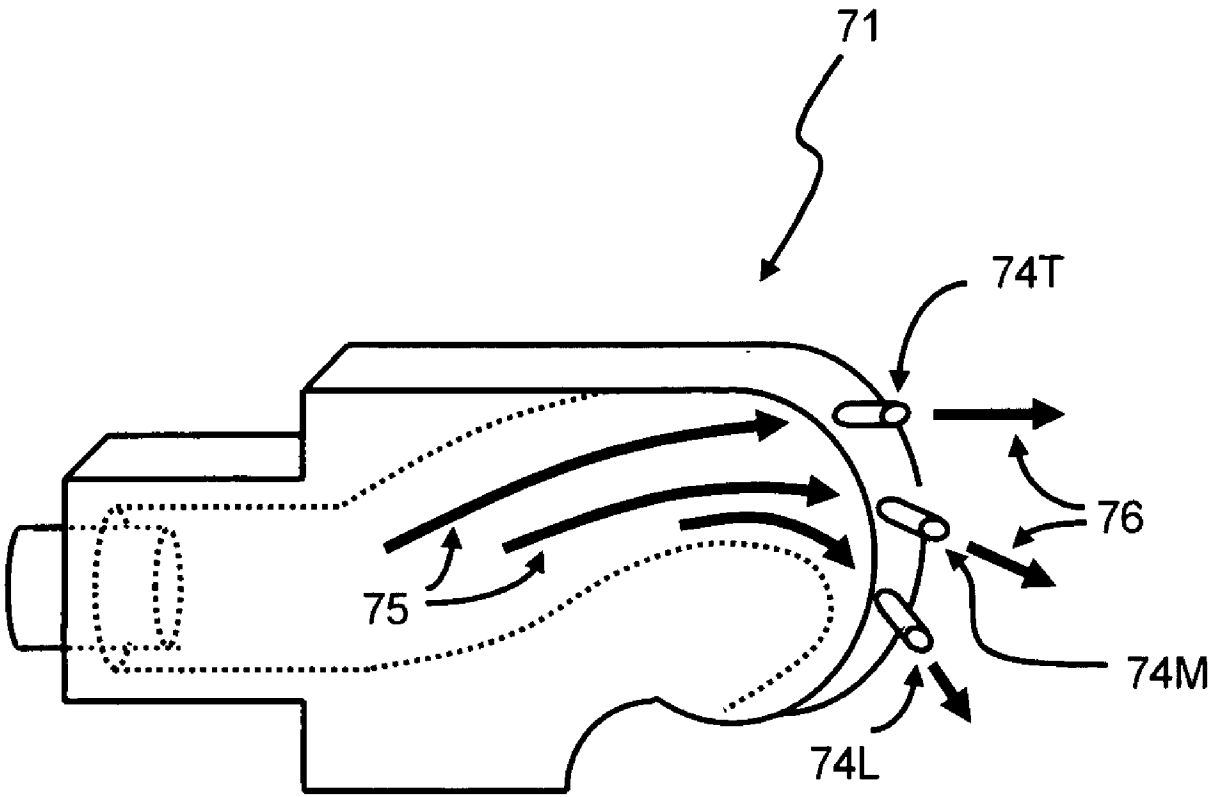
FIG. 7 shows another preferred embodiment which employs outlet tubes that are at least substantially tangentially aligned to a manifold curvature to effectively capture momentum by enabling the ion flow momentum to travel through the short tubes and continue on a straight line course.

FIG. 7 shows a manifold 71 with short tubes/tubelettes 74T, 74M, 74L that, unlike at least some of the outlets shown in FIG. 6, are tangentially aligned with the curved interior surface of the manifold to utilize the momentum lines 75 where they are positioned. As recited in classical physics, momentum is constrained to a circular path by applying a centripetal (inward) force. In this case, the centripetal force is provided by the shape of the interior surface of the through channel. When the centripetal force releases (due to the presence of an outlet), the momentum continues as straight line momentum 76. In this diagram, the outlet cylinders/tubelettes 74T, 74M, 74L serve to remove the centripetal force, and provide optimal straight line momentum 76 toward the respective regions of a wide area target.

Industrial applications commonly call for the charge neutralization of an area that is long and narrow, rather than round or square. As is known in the art, one example of a wide-area charged target of the type generally encountered during semiconductor wafer production is a generally rectangular surface 1400 millimeters by 400 millimeters located at a specified shortest distance from a manifold.

While the invention is not so limited, it has been empirically determined that inventive manifolds with 3 to 5 orifices, each having a circular cross-sectional area with diameters of between about 0.188 inches and 0.125 inches are particularly well suited to deliver substantially uniform ion current density (i.e., uniform ion distribution) at a wide area target of the general type and/or size noted immediately above. These 3 to 5 manifold orifices may be loosely positioned along a line that corresponds to the most distant target area. As used herein, the term "loosely" means that the outlet holes (or orifices) do not have to be substantially aligned along a single line. As used herein, the term "outlet" may include a hole, an orifice, a beveled orifice, a tubelette (such as a short outlet tube as shown and described herein), an outlet cylinder and/or a spray orifice. As used herein, the term the term ionizer may include any source of ionizing energy and may include an ionizing corona electrode, nuclear disintegration, and X-rays. As is known in the art and as used herein, the term "ion flow rate" means I=U Ne: where I is ion current density [$A/m^2$], U is gas velocity [m/sec], N is ion concentration [$1/m^3$], and e is ion charge which is usually equal to electron charge [C].

A laboratory example of discharge times (i.e., a standard measure of charge neutralization efficiency) and voltage balance achieved with a 3-hole manifold is shown in FIG. 8. The charged target area was a flat grid that was 1400 mm long and 400 mm wide. The results are recorded in a format that shows the centerline performance, the performance at left 200 mm, and the performance at right 200 mm. The data shown therein was taken under standard test conditions as known in the art. These include tests of electrically floating plates (preferably with a capacitance of about 20 picoFarads (pF) to ground) which are charged (to test ion balance) and discharged (preferably from 1000 volts to 100 volts to test effectiveness) to yield the data shown in each line of the Table of FIG. 8. Readings shown in each line of the Table were compiled for repeated tests in which the flat grid was shifted by a distance of 20 centimeters for iteration. As shown in the Table of FIG. 8, a preferred embodiment of the invention was able to discharge any region of a wide area target, that is 100 centimeters by 40 centimeters, in less than about 100 seconds, with a Nitrogen flow rate of about 60 L/min and with a voltage balance of less than about 10 volts.

The inventive manifold designs disclosed herein are preferably compatible with but not limited to AC corona ionizers. For example, ionizing sources based on nuclear, X-ray, field emission or any other known in the ionization art principles may be also used with disclosed apparatus and methods.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

All of the numbers or expressions referring to quantities of ingredients, reaction conditions, etc. used in the specification and claims are to be understood as modified in all instances by the term "about." Accordingly, the numerical parameters set forth in the following specification and attached claims are approximations that can vary depending upon the desired properties, which the present invention desires to obtain.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

The discussion herein of certain preferred embodiments of the invention has included various numerical values and ranges. Nonetheless, it will be appreciated that the specified values and ranges specifically apply to the embodiments discussed in detail and that the broader inventive concepts expressed in the Summary and Claims are readily scalable as appropriate for other applications/environments/contexts. Accordingly, the values and ranges specified herein must be considered to be an illustrative, not an exhaustive, description of the principles of the present invention.

Various ionizing devices and techniques are described in the following U.S. patents and published patent application, the entire contents of which are hereby incorporated by reference: U.S. Pat. No. 5,847,917, to Suzuki, bearing application Ser. No. 08/539,321, filed on Oct. 4, 1995, issued on Dec. 8, 1998 and entitled "Air Ionizing Apparatus And Method"; U.S. Pat. No. 6,563,110, to Leri, bearing application Ser. No. 09/563,776, filed on May 2, 2000, issued on May 13, 2003 and entitled "In-Line Gas Ionizer And Method"; and U.S. Publication No. US 2007/0006478, to Kotsuji, bearing application Ser. No. 10/570,085, filed Aug. 24, 2004 and published Jan. 11, 2007, and entitled "Ionizer".

We claim:

1. An ion delivery manifold for use with an ionizer of the type that converts a non-ionized gas stream into an ionized gas stream, comprising:

a gas transport channel with at least one inlet that receives the ionized gas stream from the ionizer;

at least first and second outlets that divide the ionized gas stream flowing through the gas transport channel into first and second neutralization gas streams directed toward respective first and second regions of a wide-area target, wherein the ion flow rate exiting the first outlet is higher than the ion flow rate exiting the second outlet, wherein the first region is further from the first outlet than the second region is from the second outlet and wherein the distribution of ions reaching the first and second regions is at least generally equal.

2. The ion delivery manifold of claim 1 wherein the ionizer is closer to the first outlet than it is to the second outlet whereby recombination losses of the ionized gas stream flowing from the ionizer to the first outlet are lower than the recombination losses of the ionized gas stream flowing from the ionizer to the second outlet.

3. The ion delivery manifold of claim 1 wherein the manifold further comprises an outer surface and at least the outer surface comprises PEEK® resin.

4. The ion delivery manifold of claim 1 further comprising means for mating the gas transport channel to the ionizer selected from the group consisting of: a male-to-female slip fit, a threaded fitting, and keyed fitted surfaces.

5. The ion delivery manifold of claim 1 wherein at least a portion of the transport channel includes a curved interior surface, wherein the first and second outlets extend through the portion of the transport channel with the curved interior surface, and wherein at least one of the first and second outlets is at least substantially tangentially aligned with the curvature of the interior surface of the through-channel.

6. The ion delivery manifold of claim 5 wherein the transport channel has a varying cross-sectional area and one closed end, and wherein the cross-sectional area of the transport channel decreases gradually toward the closed end to thereby gradually increase the pressure of the ionized gas stream toward the closed end.

7. The ion delivery manifold of claim 5 wherein the first outlet is a long-distance outlet that is located such that an unobstructed path exists between the ionizer and the first outlet, and wherein the second outlet is a near-target outlet that is located such that an unobstructed path does not exist between the ionizer and the second outlet, whereby recombination losses of the ionized gas stream flowing from the ionizer to the first outlet are lower than the recombination losses of the ionized gas stream flowing from the ionizer to the second outlet.

8. The ion delivery manifold of claim 1 wherein the first and second outlets comprise tubelettes and wherein the non-ionized gas stream comprises an electropositive gas.

9. The ion delivery manifold of claim 1 wherein the first and second outlets have cross-sectional areas, and wherein the cross-sectional area of the first outlet is less than or equal to the cross-sectional area of the second outlet.

10. The ion delivery manifold of claim 1 further comprising at least a third outlet, wherein the first, second and third outlets are not substantially aligned along a single line, and wherein at least one of the outlets includes a beveled edge.

11. The ion delivery manifold of claim 1 wherein the transport channel comprises a high-temperature resistant thermoplastic channel with a charge relaxation time of at least 100 seconds and wherein the ionizer is a high frequency AC ionizer that converts the non-ionized gas stream into a bipolar ionized gas stream.

12. The ion delivery manifold of claim 1 wherein the inner surface of the gas transport channel has a surface roughness not exceeding Ra=32 micro inches to thereby reduce the residence time and recombination losses of the ionized gas stream flowing through the transport channel.

13. The ion delivery manifold of claim 1 wherein the ionizer is at least partially disposed within the gas transport channel whereby conversion of the non-ionized gas stream into an ionized gas stream occurs within the transport channel and residence time and recombination losses of the ionized gas stream within the manifold are minimized.

14. The ion delivery manifold of claim 1 wherein the ionizer is a corona discharge electrode with an ionizing tip that is oriented toward the first outlet, and wherein the electrode is positioned inside a shell with an evacuation port and an outlet that is at least partially disposed within the gas transport channel.

15. The ion delivery manifold of claim 1 wherein the manifold further comprises plural tubes, and wherein the first outlet is connected to a tube that originates closer to the transport channel inlet than any other tube.

16. A method delivering plural neutralization gas streams to respective plural regions of a wide-area charge-neutralization target, comprising:

receiving a bi-polar ionized gas stream;

dividing the ionized gas stream into plural neutralization gas streams; and directing the plural neutralization gas streams toward respective plural regions of the wide-area target, wherein the ion flow rate of one of the neutralization gas streams is higher than the ion flow rate of the other neutralization gas streams, wherein the neutralization gas stream with the highest ion flow rate is directed to a long-distance region of the wide-area target, and wherein the distribution of ions reaching the plural regions is at least generally equal.

17. The method of claim 16 wherein the step of directing further comprises discharging, from 1000 volts to 100 volts, any region of a wide area target, that is at least about 100 centimeters by 40 centimeters, in less than about 100 seconds with a voltage balance of less than about 10 volts.

18. The method of claim 16 wherein the step of dividing further comprises dividing the ionized gas stream into first, second and third neutralization gas streams, wherein the ion flow rate of the first neutralization gas stream is higher than the ion flow rate of the second neutralization gas stream and the ion flow rate of the second neutralization gas stream is higher than the ion flow rate of the third neutralization gas streams; and directing further comprises directing the first, second and third neutralization gas streams toward respective, first second and third regions of the wide-area target, wherein the first neutralization gas stream is directed to a long-distance region of the wide-area target, wherein the second neutralization gas stream is directed to a mid-target region of the wide-area target, and wherein the third neutralization gas stream is directed to a near-target region of the wide-area target.

19. The method of claim 16 wherein the step of dividing the ionized gas stream into plural neutralization gas streams comprises dividing the ionized gas stream into bi-polar high-velocity, medium velocity and low-velocity neutralization gas streams, and wherein the high-velocity neutralization gas stream has the highest ion flow rate.

20. An ionizing manifold for receiving a non-ionized gas stream and for delivering plural neutralization gas streams to a wide-area target, comprising:

an AC ionizer having a corona discharge electrode for producing bi-polar charge carriers within the non-ionized gas stream to thereby form an ionized gas stream flowing in a downstream direction;

a gas transport channel having an interior through which the ionized gas stream flows, wherein the electrode is at least partially disposed within the transport channel;

a reference electrode at least partially disposed downstream of the corona discharge electrode; and at least first and second outlets that divide the ionized gas stream into first and second neutralization gas streams exiting the transport channel, wherein the ion flow rate of the first neutralization gas stream is different than the ion flow rate of the second neutralization gas stream, wherein the first and second neutralization gas streams are directed toward respective first and second regions of a wide-area target, wherein the ion flow rate exiting the first outlet is higher than the ion flow rate exiting the second outlet, wherein the first region is further from the first outlet than the second region is from the second outlet, and wherein the distribution of ions reaching the first and second regions is at least generally equal.

21. The ionizing manifold of claim 20 wherein the transport channel further comprises an outside surface, at least a portion of which is formed of a polymer with a charge relaxation time of at least 100 seconds, the ionizer is a high frequency AC ionizer, and the reference electrode is disposed on the portion of the outside surface that is formed of a polymer.

22. The ionizing manifold of claim 20 wherein the reference electrode is integrated into the transport channel and wherein the non-ionized gas stream comprises an electropositive gas.

23. The ionizing manifold of claim 20 wherein at least a portion of the transport channel includes a curved interior surface, wherein the first and second outlets extend through the portion of the transport channel with the curved interior surface, and wherein at least one of the first and second outlets is at least substantially tangentially aligned with the curvature of the interior surface of the through-channel.

24. The ionizing manifold of claim 20 wherein the first outlet is a long-distance outlet that is located such that an unobstructed path exists between the electrode and the first outlet, and the second outlet is a near-target outlet that is located such that an unobstructed path does not exist between the electrode and the second outlet, whereby recombination losses of the ionized gas stream flowing from the electrode to the first outlet are lower than the recombination losses of the ionized gas stream flowing from the electrode to the second outlet.

25. The ionizing manifold of claim 20 wherein the first and second outlets have cross-sectional areas, and the cross-sectional area of the first outlet is less than or equal to the cross-sectional area of the second outlet.

26. The ionizing manifold of claim 20 wherein the electrode is closer to the first outlet than it is to the second outlet whereby recombination losses of the ionized gas stream flowing from the ionizer to the first outlet are lower than the recombination losses of the ionized gas stream flowing from the ionizer to the second outlet.

27. The ionizing manifold of claim 20 wherein at least a portion of the transport channel includes a curved interior surface, wherein the first and second outlets extend through the portion of the transport channel with the curved interior surface, and the first and second neutralization streams exiting the transport channel move toward the first and second regions due to tangential and centripetal forces created by the curved interior surface of the transport channel.

* * * * *